US009690316B2

(12) United States Patent
Yun

(10) Patent No.: US 9,690,316 B2
(45) Date of Patent: Jun. 27, 2017

(54) INTEGRATED CIRCUIT AND METHOD FOR DRIVING THE SAME

(71) Applicant: SK hynix Inc., Gyeonggi-do (KR)

(72) Inventor: Gun-Hee Yun, Gyeonggi-do (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 15/099,303

(22) Filed: Apr. 14, 2016

(65) Prior Publication Data

US 2017/0153657 A1 Jun. 1, 2017

(30) Foreign Application Priority Data

Nov. 30, 2015 (KR) ..... 10-2015-0168720

(51) Int. Cl.
*G05F 3/26* (2006.01)

(52) U.S. Cl.
CPC ..... *G05F 3/262* (2013.01)

(58) Field of Classification Search
CPC . G05F 3/30; G05F 3/245; G05F 3/247; G05F 3/265; G05F 3/267
USPC ..... 323/312–313
See application file for complete search history.

(56) References Cited

U.S. PATENT DOCUMENTS 4,525,683 A * 6/1985 Jason ..... G05F 3/265 330/288
5,382,916 A * 1/1995 King ..... G05F 3/30 257/E27.015
5,479,092 A * 12/1995 Pigott ..... G05F 1/463 323/313
5,631,599 A * 5/1997 Bacrania ..... G05F 3/262 323/312
5,966,007 A * 10/1999 Okada ..... G05F 3/225 323/315
2005/0094690 A1* 5/2005 Kubota ..... H01S 5/042 372/38.02
2016/0170432 A1* 6/2016 Kang ..... G05F 3/26 323/313

FOREIGN PATENT DOCUMENTS

KR 1020040019157 3/2004

* cited by examiner

*Primary Examiner* — Yemane Mehari
(74) *Attorney, Agent, or Firm* — IP & T Group LLP

(57) ABSTRACT

An integrated circuit includes: a source current generation block suitable for generating a source current; a first mirroring block suitable for generating first and second mirroring currents corresponding to the source current; a second mirroring block suitable for generating a third mirroring current and a reference current corresponding to the first mirroring current; a first correction block suitable for correcting a current mismatch between the source current, the first mirroring current and the second mirroring current based on the third mirroring current; and a second correction block suitable for correcting a current mismatch between the first mirroring current, the third mirroring current and the reference current based on the second mirroring current.

13 Claims, 1 Drawing Sheet

INTEGRATED CIRCUIT AND METHOD FOR DRIVING THE SAME

CROSS-REFERENCE TO RELATED APPLICATIONS

The present application claims priority of Korean Patent Application No, 10-2015-0168720, filed on Nov. 30, 2015, which is incorporated herein by reference in its entirety.

BACKGROUND

1. Field

Exemplary embodiments of the present invention relate to a semiconductor design technology and, more particularly, to an integrated circuit and a method for driving the same.

2. Description of the Related Art

In order to perform a stable operation, integrated circuits use a reference current. The reference current is an essential element for securing the stable operation of the integrated circuits in poor conditions, such as variations in a fabrication process, and a temperature.

SUMMARY

Various embodiments of the present invention are directed to an integrated circuit capable of correcting a current mismatch between a source current and a reference current, and a method for driving the integrated circuit.

Further, various embodiments of the present invention are directed to an integrated circuit capable of correcting a current mismatch between a plurality of reference currents and an output current, and a method for driving the integrated circuit.

In accordance with an embodiment of the present invention, an integrated circuit includes: a source current generation block suitable for generating a source current; a first mirroring block suitable for generating first and second mirroring currents corresponding to the source current; a second mirroring block suitable for generating a third mirroring current and a reference current corresponding to the first mirroring current; a first correction block suitable for correcting a current mismatch between the source current, the first mirroring current and the second mirroring current based on the third mirroring current; and a second correction block suitable for correcting a current mismatch between the first mirroring current, the third mirroring current and the reference current based on the second mirroring current.

The first mirroring block may include: a first biasing unit coupled between a first voltage terminal and the source current generation block to generate a first bias voltage corresponding to the source current; a first mirroring unit coupled between the first voltage terminal and the second mirroring block to generate the first mirroring current based on the first bias voltage; and a second mirroring unit coupled between the first voltage terminal and the second correction block to generate the second mirroring current based on the first bias voltage.

The first correction block may include: a first cascode biasing unit coupled between the first voltage terminal and the second mirroring block to generate a first cascode bias voltage corresponding to the third mirroring current; a first cascode mirroring unit coupled between the first biasing unit and the source current generation block to generate the source current based on the first cascode bias voltage; a second cascade mirroring unit coupled between the first mirroring unit and the second mirroring block to generate the first mirroring current based on the first cascade bias voltage; and a third cascode mirroring unit coupled between the second mirroring unit and the second correction block to generate the second mirroring current based on the first cascode bias voltage.

The second mirroring block may include: a second biasing unit coupled between a second voltage terminal and the second cascode mirroring unit to generate a second bias voltage corresponding to the first mirroring current; a third mirroring unit coupled between the second voltage terminal and the first cascade biasing unit to generate the third mirroring current based on the second bias voltage; and a fourth mirroring unit coupled between the second voltage terminal and an output node of the reference current to generate the reference current based on the second bias voltage.

The second correction block may include: a second cascode biasing unit coupled between the second voltage terminal and the third cascode mirroring unit to generate a second cascode bias voltage corresponding to the second mirroring current; a fourth cascode mirroring unit coupled between the second biasing unit and the second cascode mirroring unit to generate the first mirroring current based on the second cascade bias voltage; a fifth cascode mirroring unit coupled between the third mirroring unit and the first cascode biasing unit to generate the third mirroring current based on the second cascode bias voltage; and a sixth cascade mirroring unit coupled between the fourth mirroring unit and the output node to generate the reference current based on the second cascode bias voltage.

The source current generation block may generate the source current based on a reference voltage generated from a band gap reference (BGR) circuit.

In accordance with an embodiment of the present invention, an integrated circuit includes: a current, source suitable for generating an input current; a mirroring block suitable for generating a plurality of reference currents corresponding to the input current and an output current corresponding to the reference currents; a control block suitable for controlling the reference currents to be selected based on a control code; and a correction block suitable for correcting a current mismatch between the reference currents and the output current based on a first bias voltage corresponding to the reference currents.

The mirroring block may include; a plurality of division units coupled in parallel between a first voltage terminal and the current source to generate the reference currents by dividing the input current at a predetermined ratio; and a first mirroring unit suitable for generating the output current based on the first bias voltage.

The control block may include a plurality of switching units for selectively coupling the division units with the current source based on the control code.

The correction block may include: a second mirroring unit suitable for generating a first mirroring current corresponding to the reference currents based on the first bias voltage; a first biasing unit suitable for generating a second bias voltage corresponding to the first mirroring current; a third mirroring unit suitable for generating a second mirroring current corresponding to the first mirroring current based on the second bias voltage; a second biasing unit suitable for generating a cascode bias voltage corresponding to the second mirroring current; a plurality of first cascode mirroring units coupled between the division units and the switching units to generate the mirroring currents based on the cascode bias voltage; a second cascode mirroring unit coupled between the second mirroring unit and the first biasing unit to generate the first mirroring current based on the cascode bias voltage; and a third cascode mirroring unit coupled between the first mirroring unit and an output node of the output current to generate the output current based on the cascode bias voltage.

In accordance with an embodiment of the present invention, method for driving an integrated circuit includes: generating a source current; generating first and second mirroring currents corresponding to the source current; generating a third mirroring current and a reference current corresponding to the first mirroring current; correcting a first current mismatch between the first mirroring current, the third mirroring current and the reference current based on the second mirroring current; and correcting a second current mismatch between the source current, the first mirroring current and the second mirroring current based on the third mirroring current.

The correcting of the first current mismatch may include; generating a second cascode bias voltage corresponding to the second mirroring current; and correcting the first mirroring current, the third mirroring current and the reference current based on the second cascode bias voltage.

The correcting of the second current mismatch may include: generating a first cascode bias voltage corresponding to the third mirroring current; and correcting the source current, the first mirroring current and the second mirroring current based on the first cascode bias voltage.

DETAILED DESCRIPTION

Figure 1:
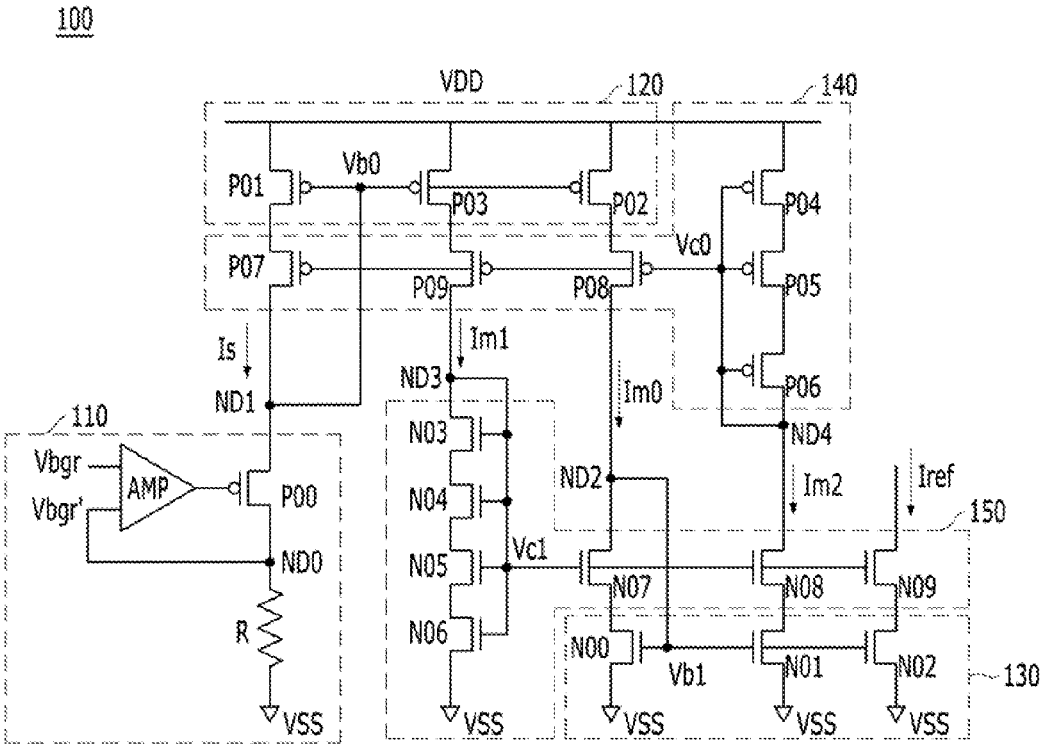
FIG. 1 is a circuit diagram illustrating an integrated circuit, in accordance with an embodiment of the present invention.

Various embodiments of the present invention are described below in more detail with reference to the accompanying drawings. The present invention may, however, be embodied in different forms and should not be construed as being limited to the embodiments set forth herein. Rather, these embodiments are provided so that this disclosure is thorough and complete, and fully convey the present invention to those skilled in the relevant art. Throughout the disclosure, like reference numerals refer to like parts throughout the various figures and embodiments of the present invention.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, indicate the presence of stated features, but do not preclude the presence or addition of one or more other features. As used herein, the term "and/or" indicates any and all combinations of one or more of the associated listed items. It is also noted that in this specification "connected/coupled" refers to one component not only directly coupling another component but also indirectly coupling another component through an intermediate component.

FIG. 1 is a circuit diagram illustrating an integrated circuit 100 in accordance with an embodiment of the present invention.

Referring to FIG. 1, the integrated circuit 100 may include a source current generation block 110, a first mirroring block 120, a second mirroring block 130, a first correction block 140, and a second correction block 150.

The source current generation block 110 may generate a source current Is corresponding to a reference voltage Vbgr. For example, the source current generation block 110 may include an operational amplifier AMP, a first PMOS transistor P00, and a resistor R. The operational amplifier AMP may receive the reference voltage Vbgr and a feedback voltage Vbgr'. The first PMOS transistor P00 may have a source coupled to a first node ND0, a drain coupled to a second node ND1, and a gate receiving an output of the operational amplifier AMP. The resistor R may be coupled between the first node ND0 and a ground voltage terminal VSS. Although not illustrated, the reference voltage Vbgr may be generated by a band gap reference (BGR) circuit.

The first mirroring block 120 may generate a first and second mirroring currents Im0 and Im1 which correspond to the source current Is. The first mirroring block 120 may include a first biasing unit including a second PMOS transistor P01, a first mirroring unit including a third PMOS transistor PO2, and a second mirroring unit including a fourth PMOS transistor PO3. The first biasing unit P01 may generate a first bias voltage Vb0 corresponding to the source current Is. For example, the second PMOS transistor P01 may have a source coupled to a power source voltage terminal VDD, a drain coupled to the second node ND1, and a gate coupled to the second node ND1. The first bias voltage Vb0 may be generated through the second node ND1. The first mirroring unit may generate the first mirroring current Im0 based on the first bias voltage Vb0. For example, the third PMOS transistor P02 may have a source coupled to the power source voltage terminal VDD and a gate receiving the first bias voltage Vb0. The second mirroring unit may generate a second mirroring current Im1 based on the first bias voltage Vb0, For example, the fourth PMOS transistor P03 may have a source coupled to the power source voltage terminal VDD and a gate receiving the first bias voltage Vb0.

The second mirroring block 130 may generate a third mirroring current Im2 and a reference current Iref which correspond to the first mirroring current Im0. For example, the second mirroring block 130 may include a second biasing unit including a first NMOS transistor N00, and third and fourth mirroring units including second and third NMOS transistors N01 and N02, respectively. The second biasing unit may generate a second bias voltage Vb1 corresponding to the first mirroring current Im0. For example, the first NMOS transistor N00 may have a source coupled to the ground voltage terminal VSS, a drain coupled to the third node ND2, and a gate coupled to the third node ND2. The second bias voltage Vb1 may be generated through a third node ND2. The third mirroring unit may generate the third mirroring current Im2 based on the second bias voltage Vb1. For example, the second NMOS transistor N01 may have a source coupled to the ground voltage terminal VSS and a gate to receiving the second bias voltage Vb1. The fourth mirroring unit may generate the reference current Iref based on the second bias voltage Vb1. For example, the third NMOS transistor N02 may have a source coupled to the ground voltage terminal VSS and a gate receiving the second bias voltage Vb1.

The first correction block 140 may correct a current mismatch between the source current Is, the first mirroring current Im0 and the second mirroring current Im1 based on the third mirroring current Im2. Drain-source voltages Vds are defined differently since the loads coupled to the drains of the second PMOS transistor P01, the third PMOS transistor P02 and the fourth PMOS transistor P03 are different. The first correction block 140 may correct the different drain-source voltages Vds. For example, the first correction block 140 may include a first cascade biasing unit, a first cascode mirroring unit, a second cascade mirroring unit, and a third cascode mirroring unit. The first cascade biasing units P04, P05 and P06 may generate a first cascode bias voltage Vc0 corresponding to the third mirroring current Im2. For example the first cascode biasing unit may include fifth to seventh PMOS transistors P04, P05 and P06, each having a source and a drain coupled in series between the power source voltage terminal VDD and a fifth node ND4 and a gate coupled to the fifth node ND4. The first cascade bias voltage Vc0 may be generated through a fifth node ND4. Although it is described as an example that the first cascade biasing unit include three PMOS transistors in the embodiment of the present invention, it is not limited to this, and the number of PMOS transistors included in the first cascade biasing unit may vary according to design. Furthermore, the first cascade mirroring unit may control the source current Is based on the first cascade bias voltage Vc0. For example, the first cascade mirroring unit may include an eighth PMOS transistor P07 having a source coupled to a drain of the second PMOS transistor P01, a source coupled to the second node ND1, and a gate receiving the first cascode bias voltage Vc0. The second cascade mirroring unit may control the first mirroring current Im0 based on the first cascode bias voltage Vc0, For example, the second cascade mirroring unit may include a ninth PMOS transistor P08 having a source coupled to a drain of the third PMOS transistor P02, a source coupled to the third node ND2, and a gate receiving the first cascade bias voltage Vc0. The third cascade mirroring unit may control the second mirroring current Im1 based on the first cascade bias voltage Vc0. For example, the third cascode mirroring unit may include a tenth PMOS transistor having a source coupled to a drain of the fourth PMOS transistor P03, a drain coupled to a fourth node ND3, and a gate receiving the first cascode bias voltage Vc0.

The second correction block 150 may correct a current mismatch between the first mirroring current Im0, the third mirroring current Im2 and the reference current Iref based on the second mirroring current Im1. Drain-source voltages Vds are defined differently since loads coupled to the drains of the first NMOS transistor N00, the second NMOS transistor N01 and the third NMOS transistor N02 are different. The second correction block 150 may correct the drain-source voltages Vds that are defined differently. For example, the second correction block 150 may include a second cascode biasing unit, a fourth cascade mirroring unit, a fifth cascode mirroring unit, and a sixth cascode mirroring unit. The second cascode biasing units N03, N04 N05 and N06 may generate a second cascode bias voltage Vc1 corresponding to the second mirroring current Im1. For example, the second cascade biasing unit may include fourth to seventh NMOS transistors N03, N04 and N05, each having a source and a drain coupled in series between the ground voltage terminal VSS and the fourth node ND3 and a gate coupled to the fourth node ND3. The second cascode bias voltage Vc1 may be generated through a fourth node ND3. Although it is described, as an example, that the second cascode biasing unit may include four NMOS transistors the present invention is not limited to this, and the number of NMOS transistors included in the first cascode biasing unit may vary according to design. Furthermore, the fourth cascode mirroring unit may control the first mirroring current Im0 based on the second cascode bias voltage Vc1. For example, the fourth cascode mirroring unit may include an eighth NMOS transistor N07 having a source coupled to a drain of the first NMOS transistor N00, a drain coupled to the third node ND2, and a gate receiving the second cascode bias voltage Vc1. The fifth cascode mirroring unit may control the third mirroring current Im2 based on the second cascode bias voltage Vc1. For example, the fifth cascode mirroring unit may include a ninth NMOS transistor N08 having a source coupled to a drain of the second NMOS transistor N01, a drain coupled to the fifth node ND4, and a gate receiving the second cascode bias voltage Vc1. The sixth cascode mirroring unit may control the reference current Iref based on the second cascode bias voltage Vc1. For example, the sixth cascode mirroring unit may include a tenth NMOS transistor N09 having a source coupled to a drain of the third NMOS transistor N02, a drain coupled to an output node of the reference current Iref, and a gate receiving the second cascode bias voltage Vc1.

When the source current generation block 110 generates the source current Is corresponding to the reference voltage Vbgr, the first mirroring block 120 may mirror the source current Is to generate the first mirroring current Im0 and the second mirroring current Im1, and the second mirroring block 130 may mirror the first mirroring current Im0 to generate the third mirroring current Im2 and the reference current Iref.

The first mirroring block 120 may not be able to generate the first mirroring current Im0 and the second mirroring current Im1 which correspond to the source current Is. This is because the drain-source voltage Vds of the second PMOS transistor P01 and the drain-source voltage Vds of the third PMOS transistor P02 and the drain-source voltage Vds of the fourth PMOS transistor P03 are defined differently since the load coupled to the drain of the second PMOS transistor P01, the load coupled to the drain of the third PMOS transistor P02 and the load coupled to the drain of the fourth PMOS transistor P03 are different, respectively. Therefore, a current mismatch may occur between the source current Is, the first mirroring current Im0 and the second mirroring current Im1.

The first correction block 140 may correct the current mismatch between the source current Is, the first mirroring current Im0 and the second mirroring current Im1. For example, since the first cascode mirroring unit P07 cascode-coupled to the second PMOS transistor P01, the second cascode mirroring unit P08 cascade-coupled to the third PMOS transistor P02, and the third cascode mirroring unit P09 cascode-coupled to the fourth PMOS transistor P03 receive the first cascode bias voltage Vc0 through the gates, a drain voltage Vd of the second PMOS transistor P01, a drain voltage Vd of the third PMOS transistor P02 and a drain voltage Vd of the fourth PMOS transistor P03 may be defined to be substantially identical. Therefore, the drain-source voltage Vds of the second PMOS transistor P01, the drain-source voltage Vds of the third PMOS transistor P02, and the drain-source voltage Vds of the fourth PMOS transistor P03 may be defined to be substantially identical, and the current mismatch between the source current Is, the first mirroring current Im0 and the second mirroring current Im1 may be corrected.

The second mirroring block 130 may not be able to generate the third mirroring current Im2 and the reference current Iref which correspond to the first mirroring current Im0. This is because the drain-source voltage Vds of the first NMOS transistor N00 and the drain-source voltage Vds of the second NMOS transistor N01 and the drain-source voltage Vds of the third NMOS transistor N02 are defined differently since the loads coupled to the respective drains of the first NMOS transistor N00 the second NMOS transistor N01 and the third NMOS transistor N02 are different, respectively. Therefore, a current mismatch may occur between the first mirroring current Im0, the third mirroring current Im2 and the reference current Iref.

The second correction block 150 may correct the current mismatch between the first mirroring current Im0, the third mirroring current Im2 and the reference current Iref. For example, since the eighth NMOS transistor N07 cascade-coupled to the first NMOS transistor N00, the ninth NMOS transistor N08 cascade-coupled to the second NMOS transistor N01, and the tenth NMOS transistor N09 cascode-coupled to the third NMOS transistor N02 receive the second cascode bias voltage Vc1 through the gates, a drain voltage Vd of the first NMOS transistor N00, a drain voltage Vd of the second NMOS transistor N01, and a drain voltage Vd of the third NMOS transistor N02 may be defined to be substantially identical. Therefore, the drain-source voltage Vds of the first NMOS transistor N00 the drain-source voltage Vds of the second NMOS transistor N01 and the drain-source voltage Vds of the third NMOS transistor N02 may be defined to be substantially identical, and the current mismatch between the first mirroring current Im0, the third mirroring current Im2 and the reference current Iref may be corrected.

Figure 2:
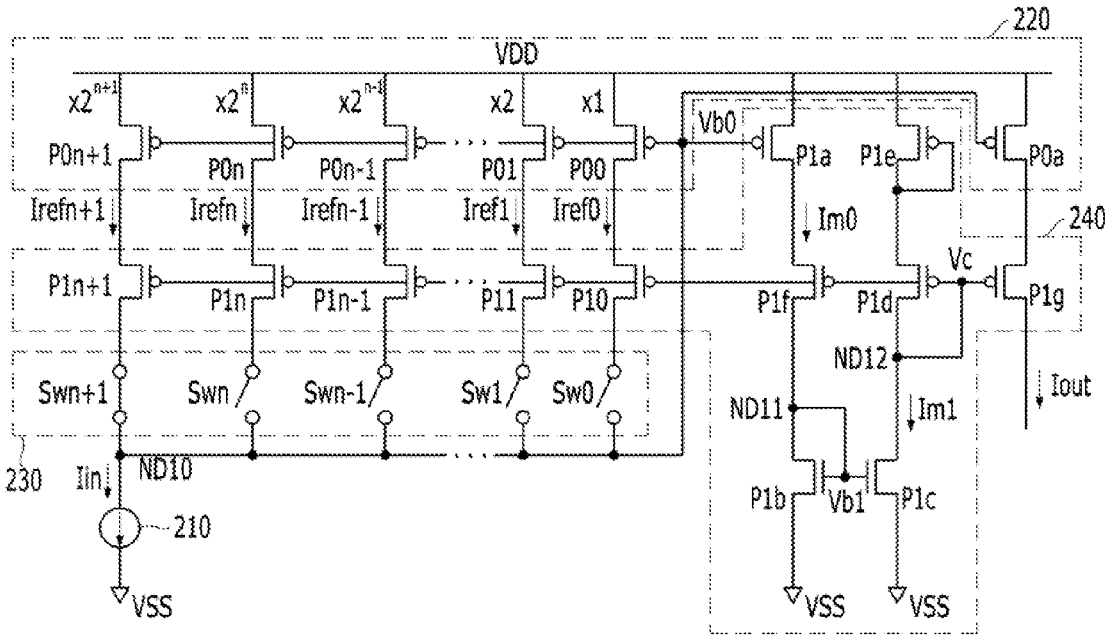
FIG. 2 is a circuit diagram illustrating an integrated circuit, in accordance with an embodiment of the present invention.

FIG. 2 is a circuit diagram illustrating an integrated circuit 200, in accordance with an embodiment of the present invention.

Referring to FIG. 2, the integrated circuit 200 may include a current source 210, a mirroring block 220, a control block 230, and a correction block 240.

The current source 210 may be coupled between a first node ND10 and a ground voltage terminal VSS to generate an input current Iin. For example, the current source 210 may have a configuration similar to the source current generation block 110 shown in FIG. 1. In this case, the input current Iin may correspond to the source current Is shown in FIG. 1. The current source 210 may include the source current generation block 110, the first mirroring block 120, the second mirroring block 130, the first correction block 140, and the second correction block 150 shown in FIG. 1. In this case, the input current Iin may correspond to the reference current Iref shown in FIG. 1. Current generation circuits having various structures may be applied to the current source 210.

The mirroring block 220 may generate a plurality of reference currents Iref0 to Irefn+1 corresponding to the input current Iin and an output current Iout corresponding to the reference currents Iref0 to Irefn+1. For example, the mirroring block 220 may include a plurality of division units and a first mirroring unit.

The division units may be coupled to a power source voltage terminal VDD in parallel. The division units may divide the input current Iin at a predetermined ratio to generate the reference currents Iref0 to Irefn+1. For example, the division units may include PMOS transistors P00 to P0*n*+1 each having a source coupled to the power source voltage terminal VDD and a gate receiving a first bias voltage Vb0. The PMOS transistors P00 to P0*n*+1 may be designed to have different channel sizes. For example, the PMOS transistor P0*n* may have a channel size $2^n$ times greater than that of the PMOS transistor P00. The first bias voltage Vb0 may be generated through the first node ND10. A level of the first bias voltage Vb0 may be defined based on the reference currents Iref0 to Irefn+1.

The first mirroring unit may generate the output current Iout corresponding to the reference currents Iref0 to Irefn+1 based on the first bias voltage Vb0. For example, the first mirroring unit may include a PMOS transistor P0*a* having a source coupled to the power source voltage terminal VDD and a gate receiving the first bias voltage Vb0.

The control block 230 may control the respective reference currents Iref0 to Irefn+1 to be selected based on a control code (not illustrated). For example, the control block 230 may include a plurality of switching units SW0 to SWn+1 coupled to the first node ND10 in parallel. The switching units SW0 to SWn+1 may selectively allow the reference currents Iref0 to Irefn+1 to flow through the first node ND10 based on the control code.

The correction block 240 may correct a current mismatch between of the reference currents Iref0 to Irefn+1 and the output current Iout based on the first bias voltage Vb0. For example the correction block 240 may include a second mirroring unit, a first biasing unit, a third mirroring unit, a second biasing unit, a voltage drop unit, a plurality of first cascode mirroring units, a second cascode mirroring unit, and a third cascode mirroring unit.

The second mirroring unit may generate a first mirroring current Im0 corresponding to the reference currents Iref0 to Irefn+1 based on the first bias voltage Vb0. For example, the second mirroring unit may include a PMOS transistor P1*a* having a source coupled to the power source voltage terminal VDD, a drain coupled to one end of the second cascode mirroring unit, and a gate coupled to the first node ND10.

The first biasing unit may generate a second bias voltage Vb1 corresponding to the first mirroring current Im0. For example, the first biasing unit may include an NMOS transistor P1*b* having a source coupled to the ground voltage terminal VSS, a drain coupled to the other end of the second cascode mirroring unit (i.e., "a second node ND11"), and a gate coupled to the second node ND11.

The third mirroring unit may generate a second mirroring current Im1 corresponding to the first mirroring current Im0 based on the second bias voltage. For example, the third mirroring unit may include an NMOS transistor P1*c* having a source coupled to the ground voltage terminal VSS, a drain coupled to a third node ND12, and a gate coupled to the second node ND11.

The second biasing unit may generate a cascode bias voltage Vc corresponding to the second mirroring current Im1. For example, the second biasing unit may include a PMOS transistor P1*d* having a gate and a drain coupled to the third node ND12. The cascode bias voltage Vc may be generated through the third node ND12. A level of the cascode bias voltage Vc may be defined corresponding to the second mirroring current Im1.

The voltage drop unit may drop a power source voltage VDD by a predetermined level to supply to the PMOS transistor P1*d*. For example, the voltage drop unit may include a PMOS transistor P1*e* having a source coupled to the power source voltage terminal VDD, a drain coupled to a source of the PMOS transistor P1*d*, and a gate coupled to the source of the PMOS transistor P1*d*.

The first cascade mirroring units may generate the reference currents Iref0 to Irefn+1 based on the cascade bias voltage Vc. For example, the first cascade mirroring units may include a plurality of PMOS transistors P10 to P1*n*+1, each having a source coupled to the PMOS transistors P00 to P0*n*+1, a drain coupled to the switching units SW0 to SWn+1, and a gate coupled to the third node ND12, respectively. The PMOS transistors P10 to P1*n*+1 may be designed to have different channel sizes, similarly to the PMOS transistors P00 to P0*n*+1. Meanwhile, the first cascade mirroring units P10 to P1*n*+1 may be designed to have the same channel size, regardless of the PMOS transistors P00 to P0*n*+1.

The second cascade mirroring unit may generate the first mirroring current Im0 based an the cascade bias voltage Vc. For example, the second cascade mirroring unit may include a PMOS transistor P1*f* having a source coupled to the drain of the PMOS transistor P1*a*, a drain coupled to the second node ND11 and a gate coupled to the third node ND12.

The third cascade mirroring unit may generate the output current Iout based on the cascode bias voltage Vc. For example, the third cascade mirroring unit may include a PMOS transistor P1*g* having a source coupled to the drain of the PMOS transistor P0*a*, a drain coupled to an output node of the output current Iout, and a gate coupled to the third node ND12.

The control block 230 may control the mirroring block 220 to generate one or more reference currents that are previously set among the reference currents Iref0 to Irefn+1 based on the control code. For example, one or more switching units that are previously set among the switching units SW0 to SWn+1 may be short-circuited. For the sake of convenience in description, it is described below as an example that the switching unit SWn+1 is short-circuited.

When the input current Iin is generated by the current source 210, the mirroring block 220 may generate the reference current Irefn+1 corresponding to the input current Iin among the reference currents Iref0 to Irefn+1 and generate the output current Iout by mirroring the reference current Irefn+1.

The mirroring block 220 may not be able to generate the output current Iout corresponding to the reference current Irefn+1. This is because a drain-source voltage Vds of the division unit P0*n*+1 and a drain-source voltage Vds of the first mirroring unit P0*a* may be defined differently since a load coupled to the drain of the division unit P0*n*+1 and a load coupled to the drain of the first mirroring unit P0*a* are different, respectively. Accordingly, a current mismatch may occur between the reference current Irefn+1 and the output current Iout.

The correction block 240 may correct the current mismatch between the reference current Irefn+1 and the output current Iout. For example, since the PMOS transistor P1*n*+1 of cascode-coupled to the PMOS transistor P0*n*+1 of and the PMOS transistor P1*g* cascode-coupled to the PMOS transistor P0*a* receive the cascode bias voltage Vc through the gates thereof, a drain voltage Vd of the PMOS transistor P0*n*+1 and a drain voltage Vd of the PMOS transistor P0*a* may be defined to be substantially identical. Accordingly, the drain-source voltage Vds of the PMOS transistor P0*n*+1 and the drain-source voltage Vds of the PMOS transistor P0*a* may be defined to be substantially identical, and the current mismatch between the reference current Irefn+1 and the output current Iout may be corrected.

In accordance with the embodiments of the present invention, a current mismatch between two or more currents may be corrected, and a cascode bias voltage may be generated by adding a simple circuit.

As the current mismatch between two or more currents is corrected, the operational reliability of an integrated circuit may be improved.

In addition, since the cascode bias voltage is generated by adding a simple circuit, a circuit design may be quite easy, and the size of an added area needed to accommodate the simple circuit may be minimized.

While the present invention has been described with respect to specific embodiments, the embodiments are not intended to be restrictive but rather descriptive. Further, it is noted that the present invention may be achieved in various ways through substitution, change, and modification, by those skilled in the art without departing from the spirit and or scope of the present invention as defined by the following claims.

What is claimed is:

1. An integrated circuit, comprising:

a source current generation block suitable for generating a source current;

a first mirroring block suitable for generating first and second mirroring currents corresponding to the source current;

a second mirroring block suitable for generating a third mirroring current and a reference current corresponding to the first mirroring current;

a first correction block suitable for correcting a current mismatch between the source current, the first mirroring current and the second mirroring current based on the third mirroring current; and a second correction block suitable for correcting a current mismatch between the first mirroring current, the third mirroring current and the reference current based on the second mirroring current.

2. The integrated circuit of claim 1, wherein the first mirroring block includes:

a first biasing unit coupled between a first voltage terminal and the source current generation block to generate a first bias voltage corresponding to the source current;

a first mirroring unit coupled between the first voltage terminal and the second mirroring block to generate the first mirroring current based on the first bias voltage; and a second mirroring unit coupled between the first voltage terminal and the second correction block to generate the second mirroring current based on the first bias voltage.

3. The integrated circuit of claim 2, wherein the first correction block includes:

a first cascode biasing unit coupled between the first voltage terminal and the second mirroring block to generate a first cascade bias voltage corresponding to the third mirroring current;

a first cascade mirroring unit coupled between the first biasing unit and the source current generation block to generate the source current based on the first cascade bias voltage;

a second cascode mirroring unit coupled between the first mirroring unit and the second mirroring block to generate the first mirroring current based on the first cascade bias voltage; and a third cascode mirroring unit coupled between the second mirroring unit and the second correction block to generate the second mirroring current based on the first cascode bias voltage.

4. The integrated circuit of claim 3, herein the second mirroring block includes:

a second biasing unit coupled between a second voltage terminal and the second cascade mirroring unit to generate a second bias voltage corresponding to the first mirroring current;

a third mirroring unit coupled between the second voltage terminal and the first cascode biasing unit to generate the third mirroring current based on the second bias voltage; and a fourth mirroring unit coupled between the second voltage terminal and an output node of the reference current to generate the reference current based on the second bias voltage.

5. The integrated circuit of claim 4, wherein the second correction block includes:

a second cascode biasing unit coupled between the second voltage terminal and the third cascade mirroring unit to generate a second cascade bias voltage corresponding to the second mirroring current;

a fourth cascode mirroring unit coupled between the second biasing unit and the second cascode mirroring unit to generate the first mirroring current based on the second cascade bias voltage;

a fifth cascade mirroring unit coupled between the third mirroring unit and the first cascade biasing unit to generate the third mirroring current based on the second cascode bias voltage; and a sixth cascode mirroring unit coupled between the fourth mirroring unit and the output node to generate the reference current based on the second cascade bias voltage.

6. The integrated circuit of claim 1, wherein the source current generation block generates the source current based on a reference voltage generated from a band gap reference (BGR) circuit.

7. An integrated circuit, comprising:

a current source suitable for generating an input current;

a mirroring block suitable for generating a plurality of reference currents corresponding to the input current and an output current corresponding to the reference currents;

a control block suitable for controlling the reference currents to be selected based on a control code; and a correction block suitable for correcting a current mismatch between the reference currents and the output current based on a first bias voltage corresponding to the reference currents.

8. The integrated circuit of claim 7, wherein the mirroring block includes:

a plurality of division units coupled in parallel between a first voltage terminal and the current source, to generate the reference currents by dividing the input current at a predetermined ratio; and a first mirroring unit suitable for generating the output current based on the first bias voltage.

9. The integrated circuit of claim 8, wherein the control block includes a plurality of switching units for selectively coupling the division units with the current source based on the control code.

10. The integrated circuit of claim 9, wherein the correction block includes:

a second mirroring unit suitable for generating a first mirroring current corresponding to the reference currents based on the first bias voltage;

a first biasing unit suitable for generating a second bias voltage corresponding to the first mirroring current;

a third mirroring unit suitable for generating a second mirroring current corresponding to the first mirroring current based on the second bias voltage;

a second biasing unit suitable for generating a cascode bias voltage corresponding to the second mirroring current;

a plurality of first cascade mirroring units coupled between the division units and the switching units to generate the mirroring currents based on the cascode bias voltage;

a second cascode mirroring unit coupled between the second mirroring unit and the first biasing unit to generate the first mirroring current based on the cascode bias voltage; and a third cascade mirroring unit coupled between the first mirroring unit and an output node of the output current to generate the output current based on the cascode bias voltage.

11. A method for driving an integrated circuit, comprising:

generating a source current;

generating first and second mirroring currents corresponding to the source current;

generating a third mirroring current and a reference current corresponding to the first mirroring current;

correcting a first current mismatch between the first mirroring current, the third mirroring current and the reference current based on the second mirroring current; and correcting a second current mismatch between the source current, the first mirroring current and the second mirroring current based on the third mirroring current.

12. The method of claim 11, wherein the correcting of the fret current mismatch includes:

generating a second cascode bias voltage corresponding to the second mirroring current; and correcting the first mirroring current, the third mirroring current and the reference current based on the second cascode bias voltage.

13. The method of claim 11, wherein the correcting of the second current mismatch includes:

generating a first cascode bias voltage corresponding to the third mirroring current; and correcting the source current, the first mirroring current and the second mirroring current based on the first cascode bias voltage.

* * * * *